United States Patent [19]

Durand

[11] Patent Number: 4,662,512

[45] Date of Patent: May 5, 1987

[54] UNITARY PACKAGE FOR A GLASS OR SIMILAR ARTICLE

[76] Inventor: Jean-Jacques Durand, La Garenne, 62510 Arques, France

[21] Appl. No.: 837,367

[22] Filed: Mar. 7, 1986

[51] Int. Cl.[4] ..... B65D 5/50; B65D 5/44

[52] U.S. Cl. ..... 206/45.19; 206/45.14; 206/45.31; 229/161

[58] Field of Search ..... 206/45.19, 45.14, 45.31, 206/45.34, 157; 229/161, 164

[56] References Cited

U.S. PATENT DOCUMENTS

| | | | |
|---|---|---|---|
| 2,975,891 | 3/1961 | Stone | 206/157 |
| 3,322,322 | 5/1967 | Persson | 229/169 |
| 3,750,870 | 8/1973 | Cote | 206/45.14 |
| 3,854,580 | 12/1974 | Hennessey | 206/426 |
| 3,961,706 | 6/1976 | Roccaforte et al. | 206/45.14 |
| 4,126,220 | 11/1978 | Roccaforte | 206/45.14 |
| 4,421,232 | 12/1983 | Konaka | 206/157 |
| 4,424,897 | 1/1984 | Ondris et al. | 206/45.14 |
| 4,526,316 | 7/1985 | Sutherland | 206/157 |
| 4,546,913 | 10/1985 | Castillo | 229/165 |

*Primary Examiner*—William Price
*Assistant Examiner*—Brenda J. Ehrhardt
*Attorney, Agent, or Firm*—Kimmel, Crowell & Weaver

[57] ABSTRACT

A package for glassware and the like formed from a single blank of sheet material having folding lines and cuts therein. The package is convertible from a closed protective rectangular box to a display package having reduced width side walls and being substantially open at its side opposite its back wall except for a narrow article retaining wall portion. At its end wall remote from the retaining wall portion, the package has a retention tab projecting into the open mouth of an article within the package to retain the article therein. A foldable wall portion contained in the blank collapses onto the back wall and side walls of the display package and is erectable to create a full flat wall on the protective rectangular box opposite and parallel to the back wall.

7 Claims, 6 Drawing Figures

UNITARY PACKAGE FOR A GLASS OR SIMILAR ARTICLE

BACKGROUND OF THE INVENTION

The present invention relates to a package for glassware or the like which is readily convertible from a closed protective package for the article contained therein to a display package for the article. The package is constructed from an initially flat blank of sheet material, such as cardboard, cardboard coated with plastics, or a suitable plastics material. The blank from which the package is constructed includes a number of cuts and folding lines, by means of which the flat blank can be erected to form either the closed protective package or the display package in which a large portion of the article is exposed for viewing. The blank can be manipulated by conventional packagemaking machinery or by hand.

Display packages for single glass tumblers or a stemmed glass are known in the prior art. In these known packages, about one-half of the glass article is exposed for viewing, and consequently, a large portion of the article is unprotected from shocks and dirt during storage or transporting the packaged article.

Accordingly, a prime object of the present invention is to provide a package for glassware formed from a unitary blank which can take the form of a box which substantially totally encloses and protects the article therein, and is easily convertible to a display package for the same article, including means preventing displacement and separation of the article being displayed in the package. Other objects and advantages of the invention will become apparent during the course of the following description.

DETAILED DESCRIPTION

Figure 1:
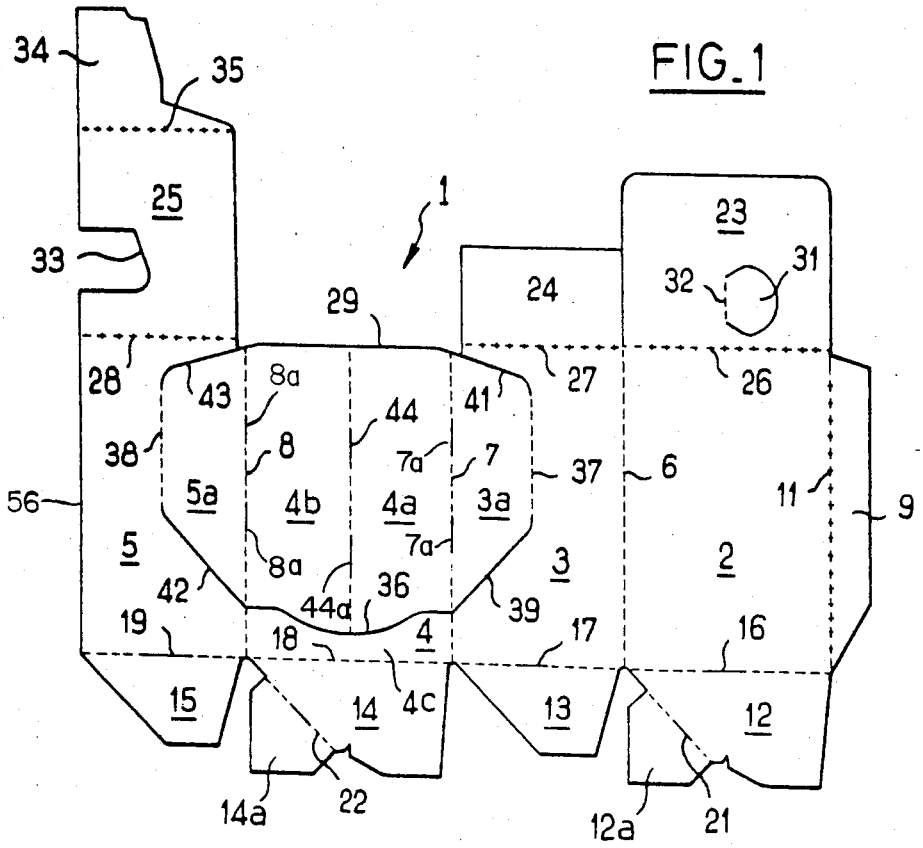
FIG. 1 is a plan view of a flat blank from which the package according to the invention is formed.

Referring to the drawings in detail, wherein like numerals designate like parts, a flat blank 1 shown in FIG. 1 is formed as a unit from cardboard, cardboard coated with plastics material or other suitable sheet material. The blank includes elongated rectangular panels 2, 3, 4 and 5 in side-by-side relationship separated by parallel folding lines 6, 7 and 8. The panels 2 and 4 have the same widths and the panels 3 and 5, which are somewhat narrower than the panels 2 and 4, also have the same widths. All of the panels 2, 3, 4 and 5 have the same lengths. A retaining tab 9 carried by the panel 2 is connected therewith on a folding line 11, parallel to the folding lines 6, 7 and 8, and extends for the length of the panel 2, as shown.

Flaps 12, 13, 14 and 15 are attached to corresponding ends of the panels 2, 3, 4 and 5 along folding lines 16, 17, 18 and 19 which are perpendicular to the lines 6, 7, 8 and 11. The flaps 12 and 14, which are identical and roughly trapezoidal, carry approximately triangular extension tabs 12*a* and 14*a* attached to the flaps 12 and 14 along folding lines 21 and 22, which are arranged at angles of 45° to the folding lines 16 . . . 19. The flaps 13 and 15, which are identical and trapezoidal, are somewhat smaller than the flaps 12 and 14. They are attached to the panels 3 and 5 and the flaps 12 and 14 are attached to the panels 2 and 4.

At their opposite ends, the panels 2, 3 and 5 carry flaps 23, 24 and 25 attached thereto on folding lines 26, 27 and 28, which are parallel to the lines 16 . . . 19. The panel 4 has no corresponding flap at its end 29. The flaps 23 . . . 25 are generally rectangular. The flaps 24 and 25 have the same widths but different lengths, the flap 24 being about one-half the length of the flap 25. The flap 23 is wider than the flaps 24 and 25 and somewhat longer than the flap 24 but somewhat shorter than the flap 25.

The flap 23 is provided roughly centrally with a retention tab 31 having an arcuate edge and being cut from the material of the flap 23 and being foldable on a folding line 32 at the lateral center of the flap 23, the line 32 being parallel to the folding lines 6, 7, 8, etc. The flap 25 has a notch 33 cut in one longitudinal edge thereof which receives the retention tab 31 in the formation of the display package, FIG. 3, in a manner to be described.

The flap 25 at its free end defined by another folding line 35, parallel to the lines 26...28 carries an extension tab 34 which is roughly one-half the width of the flap 25 and has a profiled edge as shown in FIG. 1.

The panel 4 has an arcuate cut 36 formed therethrough near and spaced from the folding line 18. End portions of the cut 36 extend to the folding lines 7 and 8, as shown in FIG. 1. Additional parallel longitudinal folding lines 38 are formed in the panels 3 and 5 near their transverse centers and toward their ends defined by folding lines 27 and 28. Convergent angular cuts 39 and 41 and 42 and 43 are formed in the panels 3 and 5 near their ends and extend to the folding lines 37 and 38. The cuts 39 and 43 extend to the ends of the cut 36 and thus form extensions thereof. Another folding line 44 parallel to the lines 7 and 8 and midway therebetween is provided at the transverse center of the panel 4 and extends from the cut 36 to the end or edge 29 of the panel 4. The folding lines 7, 8 and 44 may include cut or slit portions as shown at 7*a*, 8*a* and 44*a* in FIG. 1.

It can be seen in FIG. 1 that the folding lines 7, 8, 37, 38 and 44, together with the adjacent cuts 36, 39, 42, 43 and 41, define elongated parallel smaller panels 3*a*, 4*a*, 4*b* and 5*a*. The cut 36 of panel 4 provides thereon a relatively narrow wall portion 4c which aids in securing one end of the glassware 45 in the package, as will be further described.

To erect the convertible shipping or display package, the blank 1 is folded on lines 6, 7 and 8 and further folded on line 11. In this manner, the blank can be formed into a rectangular cross-section open sleeve. The tab 9, which has been previously coated with glue, is now adhesively attached against the interior or the exterior face of panel 5 along the longitudinal edge 5*b* thereof. The flaps 12, 13, 14 and 15 are now folded at 90° to the plane of the blank 1 on the lines 16, 17, 18 and 19 toward the interior of the sleeve, and the tabs 12*a* and 14*a*, previously coated with glue, are adhesively attached, respectively, to the flaps 13 and 15, FIG. 2, to form an end wall for the box or package. All of these operations can be performed automatically using well known machinery, or can be performed manually, if desired.

At this stage of forming the package, if it is not used immediately to receive a tumbler or other glassware, it can be returned to a flat state for easier storage, with the panels 3 and 4 lying on panels 2 and 5. This collapsing to the flat state is made possible by the parallel angular fold lines 21 and 22. The described construction results in a rectangular sleeve or box body having an automatic end wall composed of the flaps 12, 13, 14 and 15 which erects itself automatically when the structure is expanded from a flat state.

Figure 2:
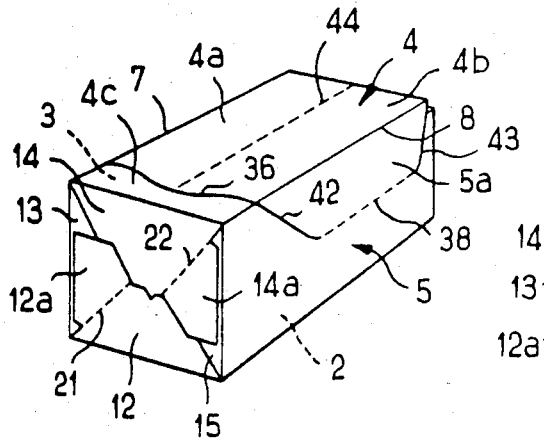
FIG. 2 is a perspective view of a shipping box or package constructed from the blank in FIG. 1.
Figure 3:
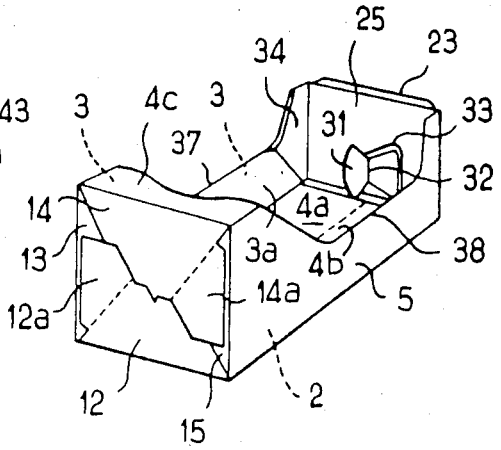
FIG. 3 is a perspective view of a display package formed from the blank in FIG. 1.
Figure 4:
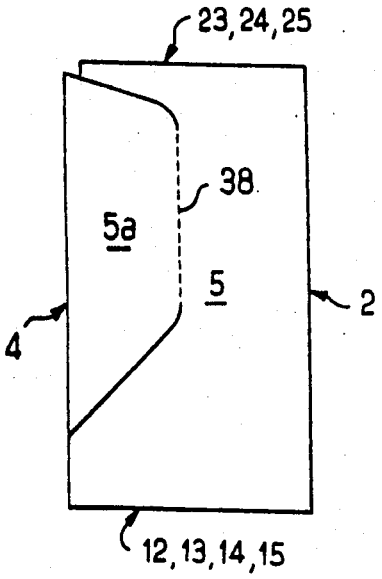
FIG. 4 is a side elevation of the box shown in FIG. 2.

The convertible package thus far described can be used directly as a low profile display package for glassware, FIG. 3, or as a completely closed protective rectangular box for a glassware article, as shown in FIG. 2.

Figure 5:
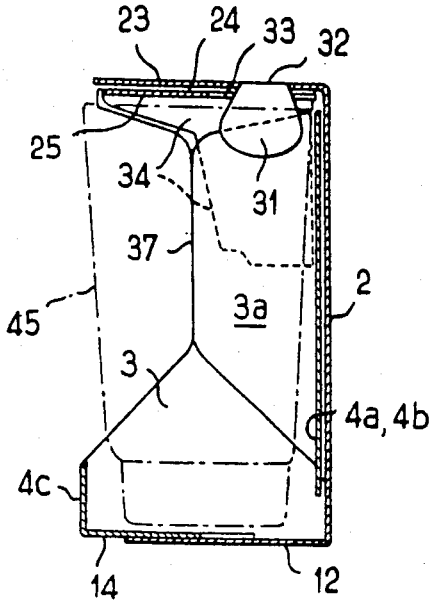
FIG. 5 is a longitudinal vertical section taken through the display package shown in FIG. 3.

In the first case, the smaller panels 4*a* and 4*b* contained in panel 4 are pushed into the interior of the box so as to lie on panel 2, the parts 3*a* and 5*a* of the two panels 3 and 5 now rotating 180° toward the interior of the box so as to lie against the remaining portions of the panels 3 and 5, as clearly shown in FIGS. 3 and 5. The glassware article 45 can then be placed in the display package, which roughly resembles a boat or sled, with the base of the glassware against the end wall composed of the flaps 12, 13, 14 and 15 and being restrained by the wall portion 4*c*, FIG. 5. The flap 25 is now folded inwardly at 90° on fold line 28, and the extension tab 34 is also folded and engaged between the panel 3 and its previously folded portion 3*a*. The flap 24 is now folded 90° on the line 27 to lie against the exterior of the flap 25, and the flap 23, previously coated with glue, is folded against flaps 24 and 25 by folding on the line 26 and is adhered to these two flaps. Finally, the retention tab 31 of the flap 23 is pushed inwardly through the notch 33 by folding on the line 32. The folded tab 31 projects into the interior of the package, FIG. 5, and into the open mouth of the glassware article 45 near the side wall thereof to retain the article 45 securely within the display package.

It can be seen in FIGS. 3 and 5 that the two side walls of the display package are deeply recessed toward the back wall 2 and the side of the package away from the wall 2 is open, except for the narrow retaining wall portion 4*c*. Thus, a large part of the article 45 is exposed safely for viewing when the package is upright, FIG. 5, or lying on its back wall 2.

In the second usage of the invention as a closed protective box, FIG. 2, the article 45 is placed in the sleeve against the closed end wall composed of flaps 12 . . . 15, and the flaps 23, 24 and 25 are folded and closed substantially in the manner previously described to complete the closed rectangular box. However, the retention tab 31 is not pushed inwardly and the flaps 23, 24 and 25 remain closed due to a small drop of glue which can be easily broken or by other means allowing a temporary closing to occur. If the fold line 44 is produced by a cut or a releasable means, the flap 23 can be permanently glued to flaps 24 and 25 and the article 45 within the box, FIG. 2, is basically completely enclosed and protected from dirt and impact. When the article in the box, FIG. 2, is to be displayed, the box can be converted easily into the display package shown in FIG. 3, as follows.

If the flap 23 is only temporarily glued to flaps 24 and 25, then the flaps 23, 24 and 25 are pulled open and the article 45 is removed from the box. However, if the flap 23 is permanently glued to flaps 24 and 25, the panel 4 is torn open along the line 44 made in the form of an incision or held by a removable band or the like, not shown, and the article 45 is removed through the opening thus made. Then, as in the first case, the panel portions 4*a* and 4*b* are pushed in against the panel 2, and panel portions 3*a* and 5*a* are folded 180°, as previously described, to lie against the remaining portions of panels 3 and 5. The article 45 is then placed in the display package, and the tab 31 is pushed inwardly to engage within the mouth of the article and retain it, as previously described.

Figure 6:
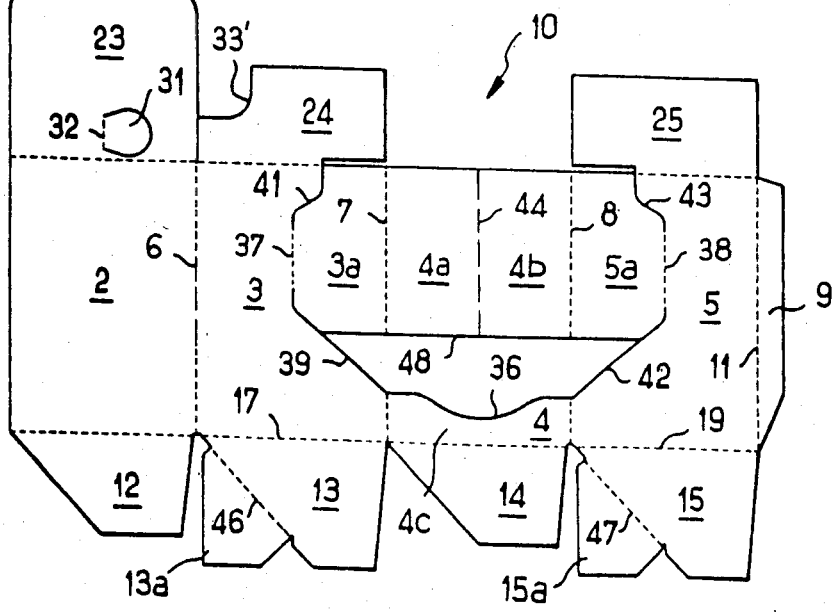
FIG. 6 is a blank embodying a modification of the invention.

In FIG. 6, a modified blank 10 for producing a modified shorter length convertible package is shown. In FIG. 6, the elements which are identical to or serve the same purpose as those in FIG. 1 are designated by the same reference numerals. The blank in FIG. 6 differs from the blank in FIG. 1 in the following manner. The tab 9 is joined along folding line 11 to the panel 5 to form one of the two side walls of the package, and the tab 9 is glued to the interior or exterior of panel 2 to form the back wall of the package. The two flaps 12 and 14 are without retaining tabs in FIG. 6 and the flaps 13 and 15 carry retaining tabs 13*a* and 15*a* which are foldable on lines 46 and 47, disposed at 45° angles to the fold lines 17 and 19 adjacent to panels 3 and 5. The two flaps 24 and 25 have basically the same dimensions and the notch 33' is no longer formed in the flap 25, but instead is formed in one corner of the flap 24. Finally, another straight cut 48 can be made in the panels 3, 4 and 5, as shown. This cut 48 is parallel to the folding lines 17 and 19, etc. and extends between the cuts 39 and 42, intersecting them. The cut 48 can be continuous or interrupted to form several attachment points which can be easily broken. The portion of the blank 10 bounded by the cuts 36, 39, 42 and 48 can be easily removed, if desired, to allow a small portion of the article within the closed box to be viewed.

In all other respects, the blank 10 in FIG. 6 is manipulated in the same manner described above for the blank 1, FIG. 1, for producing a convertible protective box or display package similar to those shown in FIGS. 2 and 3 only foreshortened somewhat between the two end walls of the package.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A unitary package for glassware and the like which is convertible from a closed protective box to a display package, the unitary package being formed from a single initially flat blank of sheet material, said blank including first, second, third and fourth rectangular panels connected together on first, second and third parallel fold lines, the first panel having a retaining tab connected thereto on a fourth fold line which is parallel to the first, second and third fold lines, said panels being foldable on said first, second and third fold lines to form a rectangular cross-section sleeve and said retaining tab being foldable on the fourth fold line to overlap a portion of the fourth panel and adapted to be adhesively attached thereto for completing said sleeve, interengaging flap means on corresponding ends of said rectangular panels and being foldable on fold lines across such ends of the panels whereby a closed end wall for said unitary package can be constructed from said flap means, said blank further including within the second, third and fourth panels a foldable portion bounded by one end of the third panel and by cuts in the second, third and fourth panels, said foldable portion being adapted to be pushed into the interior of said sleeve and to lie against said first panel and against portions of the second and fourth panels, the foldable portion after being pushed into the interior of said sleeve forming with the first panel a back wall for a display package and forming with said portions of the second and fourth panels reduced height side walls for the display package extending substantially perpendicular to said back wall, and flap means on the other ends of the first, second and fourth panels and being foldable on fold lines across said other ends and being interengageable and attachable to form a second end wall on said unitary package, the first-named and second end walls projecting well above said reduced height side walls in the display package, the flap means on said other ends of the first, second and fourth panels including a notch formed in a flap carried by the fourth panel and a retention tab cut from a flap carried by the first panel and being foldable on a folding line in the last-named flap, whereby said retention tab can be pushed through said notch and into the interior of the display package and into the interior of a glassware article held in the display package when said flap means on the other ends of the first, second and fourth panels are forming said second end wall, and said third panel having a relatively narrow article retaining wall portion at one end of the third panel bounded in part by a cut in the third panel and extending between said side walls in the display package adjacent to one edge of said closed end wall and being in spaced opposing relationship to said back wall in said display package and coacting with said retention tab to retain a glassware article in the display package.

2. A unitary package as defined in claim 1, and said foldable portion having a median fold line within the third panel parallel to the first, second and third parallel fold lines and having two additional parallel fold lines within the second and fourth panels substantially centrally thereof, and said cuts in the second and fourth panels converging and joining the ends of the fold lines within the second and fourth panels.

3. A unitary package as defined in claim 2, and the flap having said notch formed therein also having an extension tab which is insertable between the portion of the second panel and the opposing part of said foldable portion forming one reduced height side wall of the display package.

4. A unitary package as defined in claim 3, and extension tabs carried by said interengaging flap means and being foldable on parallel angular fold lines of flaps on the first and third panels and being adhesively attachable to flaps on the second and fourth panels to complete said closed end wall, and said closed end wall being collapsible and erectable by folding on said angular fold lines whereby said unitary package can be returned to a flat state.

5. A unitary package as defined in claim 2, and a cut formed in said foldable portion across the third panel and partially across the second and fourth panels and extending between and intersecting the previously-named converging cuts in the second and fourth panels to define in the second, third and fourth panels a removable section of said blank forming a small viewing window.

6. A package for a drinking glass or the like which is convertible from a closed rectangular box to a display device, said package comprising a back wall, a pair of opposite end walls rising from the back wall and a pair of side walls rising from the back wall and extending between the end walls and having reduced height portions along major portions of their lengths between the end walls, a folding wall portion on the package including a central panel adapted in one mode of use to collapse on and lie against said back wall and in another mode of use to be arranged in spaced parallel relationship with the back wall, said folding wall portion further including two side panels hinged to said central panel and hinged to the edges of the reduced height side wall portions along parallel fold lines, a narrow retaining wall portion on the package connected with one end wall thereof and connected between said side walls and being in spaced parallel relationship to one end portion of said back wall, and a retaining element on the other end wall of the package near the lateral center of the back wall and substantially between the side walls and projecting inwardly of said other end wall to enter the interior of a drinking glass being displayed in the package while the opposite end of the drinking glass is being retained by said narrow retaining wall in the display position.

7. A package for a drinking glass or the like as defined in claim 6, and the folding wall portion being terminated within the package somewhat inwardly of the end wall connected with said narrow retaining wall whereby the folding wall portion and narrow retaining wall can form a complete front wall on the package in spaced parallel relationship to said back wall when the folding wall portion is moved on its folding lines to form said closed rectagular box.

* * * * *